US010626595B2

(12) United States Patent
Ramezani

(10) Patent No.: US 10,626,595 B2
(45) Date of Patent: Apr. 21, 2020

(54) MOMENT-RESISTING FRAME

(71) Applicant: Mohammad Ramezani, Mashhad (IR)

(72) Inventor: Mohammad Ramezani, Mashhad (IR)

( * ) Notice: Subject to any disclaimer, the term of this patent is extended or adjusted under 35 U.S.C. 154(b) by 0 days.

(21) Appl. No.: 16/051,516

(22) Filed: Aug. 1, 2018

(65) Prior Publication Data

US 2018/0347172 A1 Dec. 6, 2018

Related U.S. Application Data

(60) Provisional application No. 62/547,779, filed on Aug. 19, 2017.

(51) Int. Cl.

| | |
|---|---|
| ***E04B 1/24*** | (2006.01) |
| ***E04H 9/02*** | (2006.01) |
| ***E04B 1/19*** | (2006.01) |
| *E04C 3/04* | (2006.01) |

(52) U.S. Cl.

CPC ..... *E04B 1/2403* (2013.01); *E04B 1/19* (2013.01); *E04H 9/021* (2013.01); *E04H 9/024* (2013.01); *E04B 2001/199* (2013.01); *E04B 2001/1993* (2013.01); *E04B 2001/2406* (2013.01); *E04B 2001/2415* (2013.01); *E04B 2001/2418* (2013.01); *E04B 2001/2448* (2013.01); *E04C 2003/0413* (2013.01)

(58) Field of Classification Search

CPC .. E04B 1/19; E04B 1/2403; E04B 2001/2448; E04B 2001/2418; E04B 2001/2415; E04B 2001/2406; E04B 2001/199; E04B 2001/1993; E04B 1/24; E04H 9/021; E04H 9/024; E04C 2003/0413

See application file for complete search history.

(56) References Cited

U.S. PATENT DOCUMENTS 3,295,288 A * 1/1967 Bakke ..... E04B 1/24 52/741.1
3,591,214 A * 7/1971 Gallay ..... E04B 1/2403 403/13
3,938,297 A * 2/1976 Sato ..... E04B 1/2403 403/188

(Continued)

FOREIGN PATENT DOCUMENTS

CA 2360433 A1 * 5/2001 ..... E04B 1/2403
CN 203213310 U 9/2013

(Continued)

*Primary Examiner* — Jessie T Fonseca
(74) *Attorney, Agent, or Firm* — Bajwa IP Law Firm
Haris Zaheer Bajwa

(57) ABSTRACT

Disclosed herein is a moment-resisting frame for connecting beams and columns of a structure. The moment-resisting frame may include a beam comprising a top horizontal flange, a bottom horizontal flange, and a vertical web fitted securely between the top horizontal flange and the bottom horizontal flange. The moment-resisting frame may also include a column comprising a lateral vertical flange. The lateral vertical flange may include a top flange threaded hole, a bottom flange threaded hole, a first lateral flange threaded hole, and a second lateral flange threaded hole. The moment-resisting frame may further include a plurality of rows of coplanar plates that retrofitted around an outermost periphery of the beam.

11 Claims, 5 Drawing Sheets

(56) References Cited

U.S. PATENT DOCUMENTS 4,014,089 A * 3/1977 Sato ..... E04B 1/2403 228/138
4,047,341 A * 9/1977 Bernardi ..... E04B 1/2403 403/230
4,068,964 A * 1/1978 Stoker ..... E04B 1/2403 228/182
4,074,947 A * 2/1978 Matake ..... E04B 1/2403 403/189
5,628,156 A * 5/1997 Tarics ..... E04B 1/2403 52/167.3
5,660,017 A * 8/1997 Houghton ..... E04B 1/2403 52/167.3
6,059,482 A * 5/2000 Beauvoir ..... E04B 1/2403 403/262
6,073,405 A 6/2000 Kasai et al.
6,138,427 A * 10/2000 Houghton ..... E04B 1/2403 52/236.3
6,237,303 B1 * 5/2001 Allen ..... E04B 1/2403 52/653.1
7,047,695 B2 5/2006 Allen et al.
8,800,239 B2 8/2014 Yang
2002/0184836 A1 * 12/2002 Takeuchi ..... E04B 1/2403 52/167.1
2003/0009977 A1 * 1/2003 Houghton ..... E04B 1/2403 52/656.9
2003/0041549 A1 * 3/2003 Simmons ..... E04B 1/2403 52/655.1
2004/0010992 A1 * 1/2004 Sarkisian ..... E04B 1/2403 52/289
2004/0050013 A1 * 3/2004 Okada ..... E04B 1/2403 52/848
2004/0139683 A1 * 7/2004 Simmons ..... E04B 1/2403 52/719
2007/0209314 A1 * 9/2007 Vaughn ..... E02D 27/34 52/838
2007/0261356 A1 * 11/2007 Vaughn ..... E02D 27/34 52/655.1
2009/0165419 A1 * 7/2009 Richard ..... E04B 1/24 52/650.2
2011/0030305 A1 * 2/2011 Karns ..... E04B 1/2403 52/650.1
2011/0252743 A1 * 10/2011 Yang ..... E04B 1/2403 52/849
2011/0308190 A1 * 12/2011 Pryor ..... E04B 1/2403 52/653.1
2013/0001383 A1 * 1/2013 Jay ..... E04B 1/2403 248/201
2013/0283721 A1 * 10/2013 Ahn ..... E04B 1/24 52/649.6
2014/0083046 A1 * 3/2014 Yang ..... E04B 1/24 52/704
2014/0182234 A1 * 7/2014 Yang ..... E04B 1/24 52/655.1
2015/0275501 A1 * 10/2015 Houghton ..... E04B 1/2403 52/854
2015/0322666 A1 * 11/2015 Hardy ..... E04B 1/41 52/700
2016/0356033 A1 * 12/2016 Houghton ..... E04B 1/2403
2017/0314254 A1 * 11/2017 Houghton ..... E04B 1/1912
2018/0002913 A1 * 1/2018 Oba ..... E04B 1/2403
2018/0094419 A1 * 4/2018 Houghton ..... E04B 1/1903
2018/0094420 A1 * 4/2018 Houghton ..... E04B 1/2403
2018/0347222 A1 * 12/2018 Richards ..... E04H 9/021
2018/0363287 A1 * 12/2018 Fox ..... E04B 1/2403

FOREIGN PATENT DOCUMENTS

CN 105888060 8/2016
CN 104878948 6/2017
JP 4203533 B1 * 1/2009 ..... E04B 1/2403
JP 6171070 B1 * 7/2017 ..... E04B 1/185
WO WO-2004076761 A1 * 9/2004 ..... E04B 1/2403
WO WO-2012003410 A2 * 1/2012 ..... E04B 1/2403
WO WO-2014184397 A1 * 11/2014 ..... E04B 1/24
WO WO-2015182714 A1 * 12/2015 ..... E04B 1/24
WO WO-2016036564 A1 * 3/2016 ..... E04B 1/2403
WO WO-2017026113 A1 * 2/2017 ..... E04B 1/215

* cited by examiner

MOMENT-RESISTING FRAME

CROSS-REFERENCE TO RELATED APPLICATION

This application claims the benefit of priority from U.S. Provisional Patent Application Ser. No. 62/547,779, filed on Aug. 19, 2017, and entitled "BOLTED CONNECTION OF STEEL MOMENT-RESISTING FRAMES WITH PARALLEL COLUMN FLANGE PLATES" which is incorporated herein by reference in its entirety.

TECHNICAL FIELD

The present disclosure generally relates to beam and column connections, and particularly to connections of a moment-resisting frame comprising beams and columns.

BACKGROUND

In the construction of modern structures such as buildings and bridges, generally, beams and columns are arranged and fastened together using known engineering principles and practices to form the skeletal backbone of the intended structure. The arrangement of the beams, also referred to as girders, and/or columns is carefully designed to ensure that the framework of beams and columns is able to support the stresses, strains, and loads contemplated for the intended use of the bridge, building, or other structures.

The beams and columns used in buildings are, generally, one piece, uniform steel rolled sections; and each beam and/or column, generally, includes two elongated rectangular flanges disposed in a parallel arrangement; and a web disposed centrally between the two facing surfaces of the flanges along the length of the sections. The column is, generally, longitudinally or vertically aligned in a structural frame. A beam is typically referred to as a girder when it is latitudinally or horizontally aligned in the frame of a structure. The beam and/or column are able to withstand a strongest load when the load is applied to the outer surface of one of the flanges and toward the web.

When a girder is used as a beam, the web extends vertically between an upper and lower flange to allow the upper flange surface to face and directly support the floor or roof above it. The flanges at the end of the beam are welded and/or bolted to the outer surface of a column flange. The steel frame is erected floor by floor. Each piece of structural steel, including each beam and column, is preferably prefabricated in a factory according to a predetermined size, shape, and strength specifications. Each steel beam and column is then, generally, marked for erection in the structure in the building frame. When the steel beam and columns for a floor are in a place, they are braced, checked for alignment, and then connected using conventional riveting, welding, or bolting techniques.

Making engineering assessments of loads utilizes application of current design methodologies. These assessments, are generally compounded in complexity when considering impact on loads due to seismic events and/or determining the stresses and strains caused by these loads in structures located in areas that are prone to earthquakes. It is well known that during an earthquake, the dynamic horizontal and dynamic vertical inertia loads and stresses imposed upon a building may have the most impact on the connections of the beams to columns which are supposed to constitute the earthquake damage resistant frame. Under the high loading and stress conditions during a large earthquake, or from repeated exposure to milder earthquakes, the connections between the beams and columns may fail, possibly resulting in the collapse of the structure and leading to loss of life.

While suitable for use under normal occupational loads and stresses, often these connections may not be able to withstand larger loads and stresses experienced during an earthquake. Even if these loads and stresses do not cause damage in the structure, they often cause changes in the physical properties of the connections that may be severe enough to deteriorate the structure strength. There is, therefore, a need for beam and column connections that improve the strength of steel frame structures against great unpredictable loads including loads caused by such events as earthquakes.

SUMMARY

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

In order to achieve more renitent connection between a beam and a column in a structure such as a building, a moment-resisting frame may be utilized to provide a connection for beams and columns of the structure.

In one general aspect, the present disclosure is directed to a moment-resisting frame for providing a connection between beams and columns. The moment-resisting frame includes a beam. The beam comprises a top horizontal flange, a bottom horizontal flange, and a vertical web. The vertical web may be fitted securely between the top horizontal flange and the bottom horizontal flange. Moreover, the vertical web includes a first side and a second side.

In some implementations, the moment-resisting frame may also include a column. The column may include a lateral vertical flange. Furthermore, the lateral vertical flange may include a top flange threaded hole, a bottom flange threaded hole, a first lateral flange threaded hole, and a second lateral flange threaded hole.

In some embodiments, the moment-resisting frame may also include a plurality of rows of coplanar plates. The plurality of rows of coplanar plates may be arranged in a parallel configuration relative to the vertical flange. Furthermore, each row of the plurality of rows of coplanar plates may include a top plate. The top plate includes a top threaded hole associated with the top flange threaded hole. In some implementations, the top plate may be attached vertically to a top side of the top horizontal flange in a perpendicular configuration relative to a main axis of the beam.

Also, each row of the plurality of rows of coplanar plates may include a bottom plate. The bottom plate includes a bottom threaded hole associated with the bottom flange threaded hole. In some implementations, the bottom plate may be attached vertically to a bottom side of the bottom horizontal flange in a perpendicular configuration relative to the main axis of the beam.

Each row of the plurality of rows of coplanar plates may include a first lateral plate. The first lateral plate includes a first lateral threaded hole associated with the first lateral flange threaded hole. In some implementations, the first lateral plate may be attached vertically to a bottom side of the top horizontal flange, a top side of the bottom horizontal flange, and a first side of the vertical web in a perpendicular configuration relative to the main axis of the beam.

Likewise, each row of the plurality of rows of coplanar plates may include a second lateral plate. The second lateral plate includes a second lateral threaded hole associated with the second lateral flange threaded hole. In some implementations, the second lateral plate may be attached vertically to a bottom side of the top horizontal flange, a top side of the bottom horizontal flange, and a second side of the vertical web in a perpendicular configuration relative to the main axis of the beam.

In some other embodiments, the top plate may be secured into a substantially fixed position by tightening a top lock screw inside the top threaded hole and the top flange threaded hole. The bottom plate may be secured into a substantially fixed position by tightening a bottom lock screw inside the bottom threaded hole and the bottom flange threaded hole. The first lateral plate may be secured into a substantially fixed position by tightening a first lateral lock screw inside the first lateral threaded hole and the first lateral flange threaded hole. And similarly, the second lateral plate may be secured into a substantially fixed position by tightening a second lateral lock screw inside the second lateral threaded hole and the second lateral flange threaded hole.

Other systems, methods, features and advantages of the implementations will be, or will become, apparent to one of ordinary skill in the art upon examination of the following figures and detailed description. It is intended that all such additional systems, methods, features and advantages be included within this description and this summary, be within the scope of the implementations, and be protected by the following claims.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
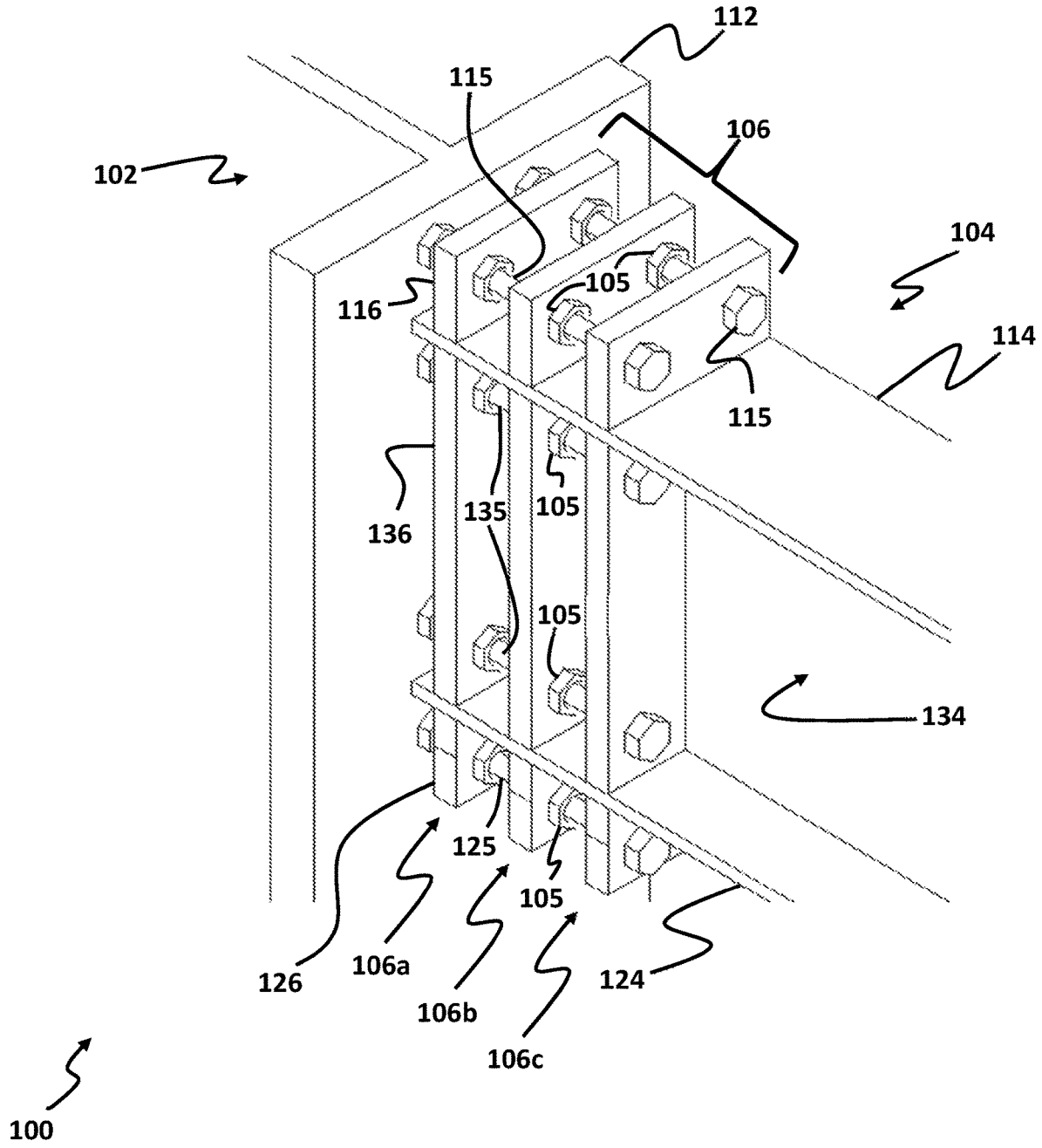
FIG. 1 illustrates a perspective view of a moment resisting frame, consistent with one or more exemplary embodiments of the present disclosure.
Figure 2:
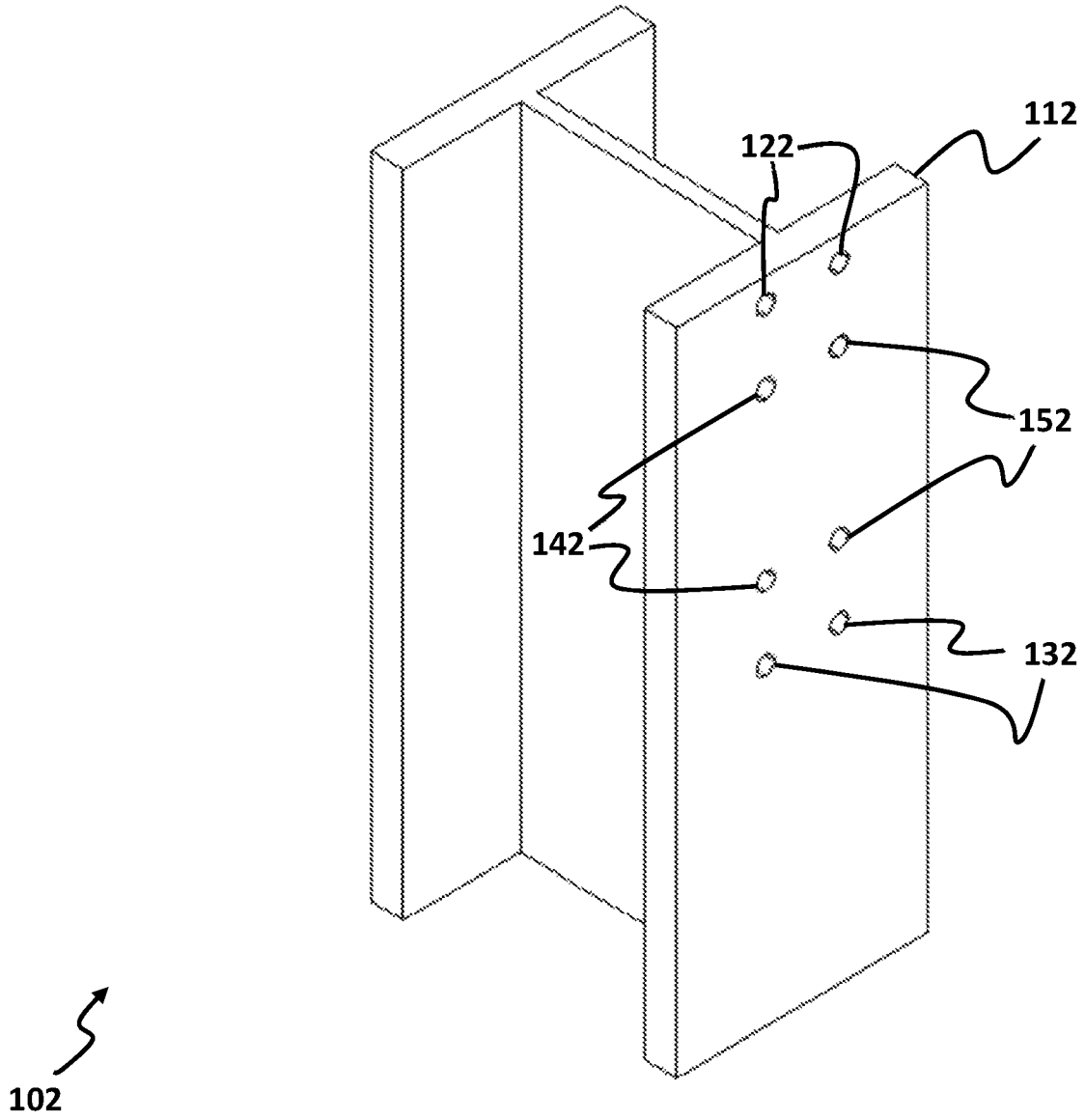
FIG. 2 illustrates a perspective view of an exemplary column utilized in a moment resisting frame, consistent with one or more exemplary embodiments of the present disclosure.
Figure 3:
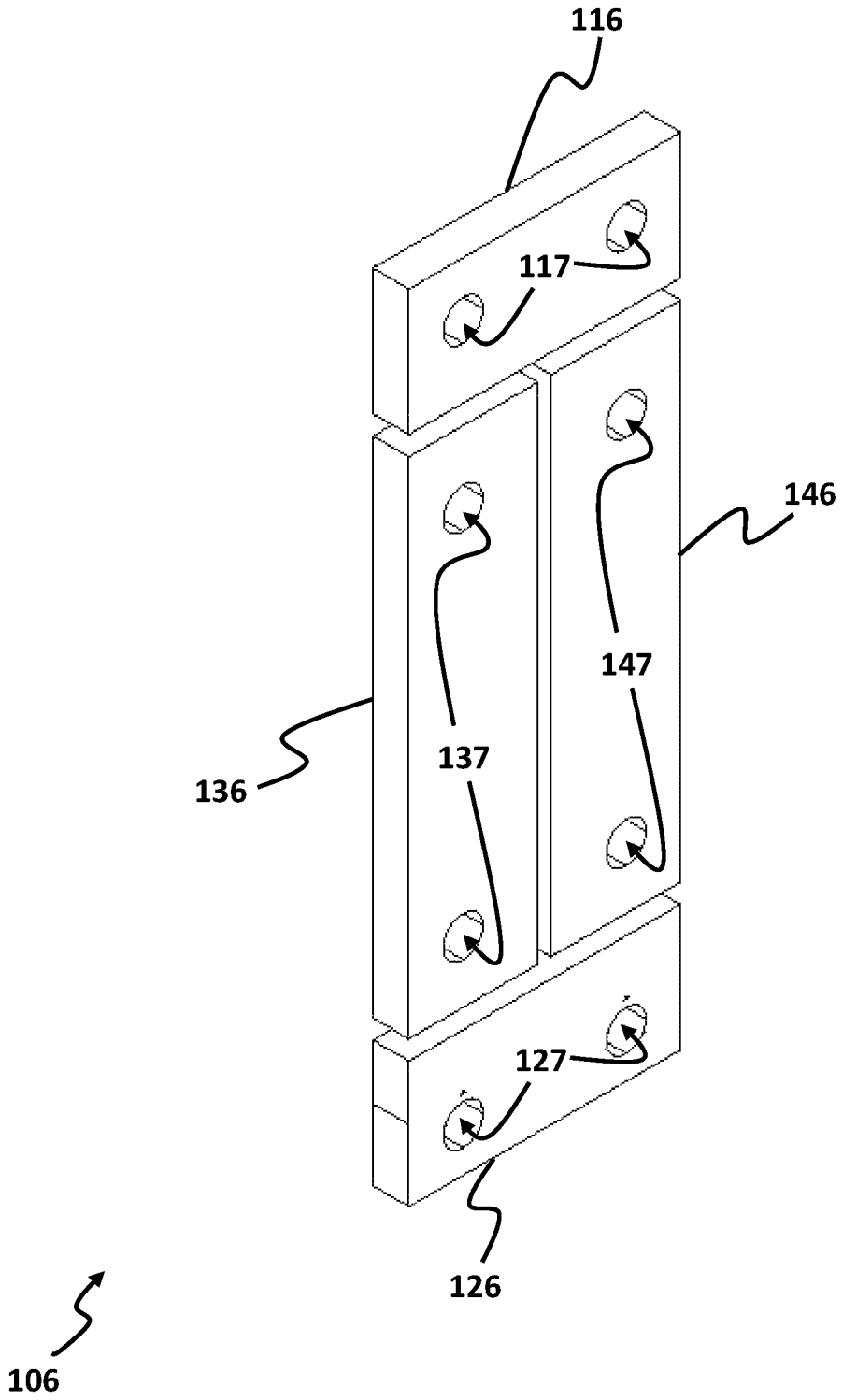
FIG. 3 illustrates a perspective view of an exemplary row of coplanar plates utilized in a moment resisting frame, consistent with one or more exemplary embodiments of the present disclosure.

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings. The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be readily apparent to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

As noted above, a moment-resisting frame generally includes a beam and a column that may be arranged in a perpendicular configuration. In some cases, a vertical cross section of the beam (at, for example, a distal end thereof) may be connected to an outermost surface of a vertical flange of the column in order to provide a secure connection between the beam and the column. Generally, the connection between the beam of the moment-resisting frame and the column of the moment-resisting frame may be implemented by welding a vertical cross section of the beam (at, for example, a distal end thereof) to an outermost surface of a vertical flange of the beam. Or alternatively, the connection between the beam of the moment-resisting frame and the column of the moment-resisting frame may be implemented by bonding using one or more of an adhesive, bolting, and other fasteners. Other methods that include direct welding or otherwise direct connections between the beam and the column in a moment-resisting frame may cause some drawbacks such as the low strength of the moment-resisting frame which may have negative impact when the frame experiences great loads and stresses, for example, during an earthquake.

The high loading forces applied to the welded beam/column connections during earthquakes are oftentimes sufficient to fracture or otherwise damage the welded connections leading to premature loss of structural integrity. Hence, from a strength viewpoint, the development of a moment-resisting frame without a direct connection between the beam and the column thereof is of significant importance.

The following disclosure describes exemplary systems and apparatuses for connecting beams and columns of a moment-resisting frame in a structure such as a building. In some implementations, the systems and apparatuses may be designed to provide relatively high strengther for steel frame structures against great unpredictable loads, such as earthquake loads, through an indirect connection between beams and columns of the moment-resisting frame. As discussed in further detail below, such systems allow for significant improvement and strength increase against external loads that may be applied to a structure such as a building.

In order to provide greater clarity regarding the implementations disclosed herein, additional details are now provided with respect to the drawings. Referring now to FIGS. 1-5, an exemplary implementation of a moment-resisting frame 100 that may be utilized with a view to provide a relatively high strength against high external loads for structures, such as buildings, is disclosed, consistent with one or more exemplary embodiments of the present disclosure. In an exemplary embodiment, the moment-resisting frame 100 may include a column 102, a beam 104, and a plurality of rows of coplanar plates 106. In an implementation, the column 102 may include a lateral vertical flange 112 at a proximal end of the column 102. In some embodiments, the lateral vertical flange 112 may have a substantially rectangular shape. However, in some other implementations, the lateral vertical flange 112 may have any other shapes such as a substantially triangular shape. For purpose of reference, it should be understood that beams and columns may be substantially similar in shape to each other. In exemplary embodiments, column may refer to a girder that is arranged vertically in a moment-resisting frame, and beam may refer to a girder that is arranged horizontally in a moment-resisting frame. Beams and columns of an exemplary moment-resisting frame, for example, the column 102 and the beam 104 of the moment-resisting frame 100 may be easily and inexpensively manufactured. Column 102 and the beam 104 of the moment-resisting frame 100 may be manufactured from stainless steel 37. However, any other material that is able to be welded to steel parts may be used to manufacture the column 102 and the beam 104.

Furthermore, the lateral vertical flange 112 may include a plurality of top flange threaded holes 122, a plurality of bottom flange threaded holes 132, a plurality of first lateral flange threaded holes 142, and a plurality of second lateral flange threaded holes 152. In exemplary embodiments, the plurality of top flange threaded holes 122, the plurality of bottom flange threaded holes 132, the plurality of first lateral flange threaded holes 142, and the plurality of second lateral flange threaded holes 152 of the lateral vertical flange 112 allow for connecting the column 102 to the beam 104 by utilizing a fastening mechanism such as bolt and/or screw.

In some implementations, the beam 104 may comprise a top horizontal flange 114, a bottom horizontal flange 124, and a vertical web 134. In some embodiments, the vertical web 134 may be fitted securely between the top horizontal flange 114 and the bottom horizontal flange 124. In an exemplary implementation, the top horizontal flange 114, the bottom horizontal flange 124, and the vertical web 134 may have a substantially rectangular shape. However, in some other implementations, the top horizontal flange 114, the bottom horizontal flange 124, and the vertical web 134 may have any other shape.

As noted above, according to some exemplary embodiments, the moment-resisting frame 100 may include a plurality of rows of coplanar plates 106. For example, as shown in FIG. 1, the moment-resisting frame 100 may include three rows of coplanar plates (a first row of coplanar plates 106*a*, a second row of coplanar plates 106*b*, and a third row of coplanar plates 106*c*). In some implementations, each row of the plurality of rows of coplanar plates 106, for example the first row of coplanar plates 106*a*, may be retrofitted around an outermost surface of the beam 104 with equal interval distances along a main length of the beam 104. In exemplary embodiments, main length of the beam 104 may refer to the vertical direction as illustrated in FIG. 1. In an exemplary embodiment, the plurality of rows of coplanar plates 106 may be retrofitted around an outermost surface of the beam 104 with different interval distances along a main length of the beam 104. According to an exemplary embodiment, each row of the plurality of rows of coplanar plates 106, for example, the first row of coplanar plates 106*a* may include a top plate 116, a bottom plate 126, a first lateral plate 136, and a second lateral plate 146. In an implementation, the top plate 116, the bottom plate 126, the first lateral plate 136, and the second lateral plate 146 may have a substantially rectangular shape. However, in some other implementations, the top plate 116, the bottom plate 126, the first lateral plate 136, and the second lateral plate 146 may have any other shape such as a substantially rectangular shape. In exemplary embodiments, top plate 116, the bottom plate 126, the first lateral plate 136, and the second lateral plate 146 that are retrofitted around the outermost surface of the beam 104 allow for connecting the beam 104 to the column 102 by utilizing a fastening mechanism such as bolt and/or screw.

Furthermore, each plate of each row of coplanar plates 106, for example plates of the first row of coplanar plates 106*a* may include a respective plurality of threaded holes. In an exemplary embodiment, the respective plurality of threaded holes of each plate of each row of coplanar plates 106, for example plates of the first row of coplanar plates 106*a*, may be associated with respective threaded holes of the lateral vertical flange 112 (including the plurality of top flange threaded holes 122, the plurality of bottom flange threaded holes 132, the plurality of first lateral flange threaded holes 142, and the plurality of second lateral flange threaded holes 152). The association between plates of each row of coplanar plates with their respective threaded holes of the lateral vertical flange allows for a connection between plates of each row of coplanar plates 106 and the lateral vertical flange 112 by a fastening mechanism such as screw and/or bolt. For example, in one exemplary embodiment of the present disclosure, the top plate 116 may include a plurality of top threaded holes 117 associated with the plurality of top flange threaded holes 122. Similarly, in some embodiments of the present disclosure, the bottom plate 126 may include a plurality of bottom threaded holes 127 associated with the plurality of bottom flange threaded holes 132. And also, the first lateral plate 136 may include a plurality of first lateral threaded holes 137 associated with the plurality of first lateral flange threaded holes 142. In an exemplary embodiment of the present disclosure, the second lateral plate 126 may include a plurality of second lateral threaded holes 147 associated with the plurality of second lateral flange threaded holes 152.

Figure 4:
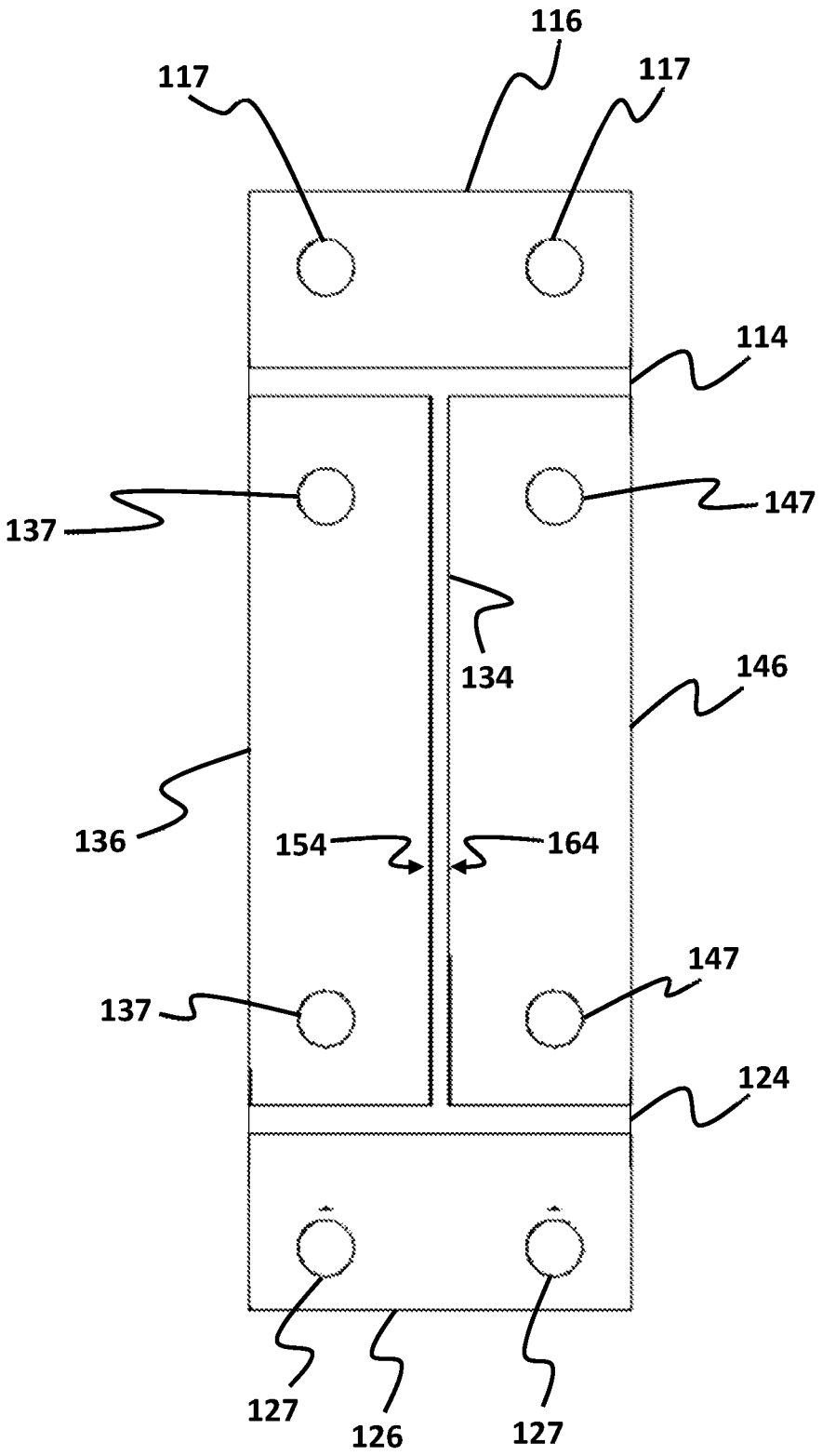
FIG. 4 illustrates a back view of an exemplary beam and a retrofitted row of coplanar plates utilized in a moment resisting frame, consistent with one or more exemplary embodiments of the present disclosure.

As shown in FIG. 1 and FIG. 4, in some embodiments, in order to retrofit plates of each row of coplanar plates 106 around the beam 104, the top plate 116 may be welded or otherwise attached vertically to a top side of the top horizontal flange 114. Similarly, in an exemplary embodiment, the bottom plate 126 may be welded or otherwise attached vertically to a bottom side of the bottom horizontal flange 124. Furthermore, the first lateral plate 136 may be welded or otherwise attached vertically to a bottom side of the top horizontal flange 114, a top side of the bottom horizontal flange 124, and a first side (visible in FIG. 1 but not separately labeled, labeled 154 in FIG. 4) of the vertical web 134. And also the second lateral plate 146 may be welded or otherwise attached vertically to a bottom side of the top horizontal flange 114, a top side of the bottom horizontal flange 124, and a second side 164 of the vertical web 134.

In an exemplary embodiment, each plate of each row of coplanar plates 106, for example plates of the first row of coplanar plates 106*a*, may be retrofitted around an outermost periphery of the beam 104 through the welding process. However, in some alternative embodiments, each plate of each row of coplanar plates 106, for example each plate of the first row of coplanar plates 106*a*, may be retrofitted around an outermost periphery of the beam 104 through any other connecting mechanisms or processes such as bonding and/or soldering.

Figure 5:
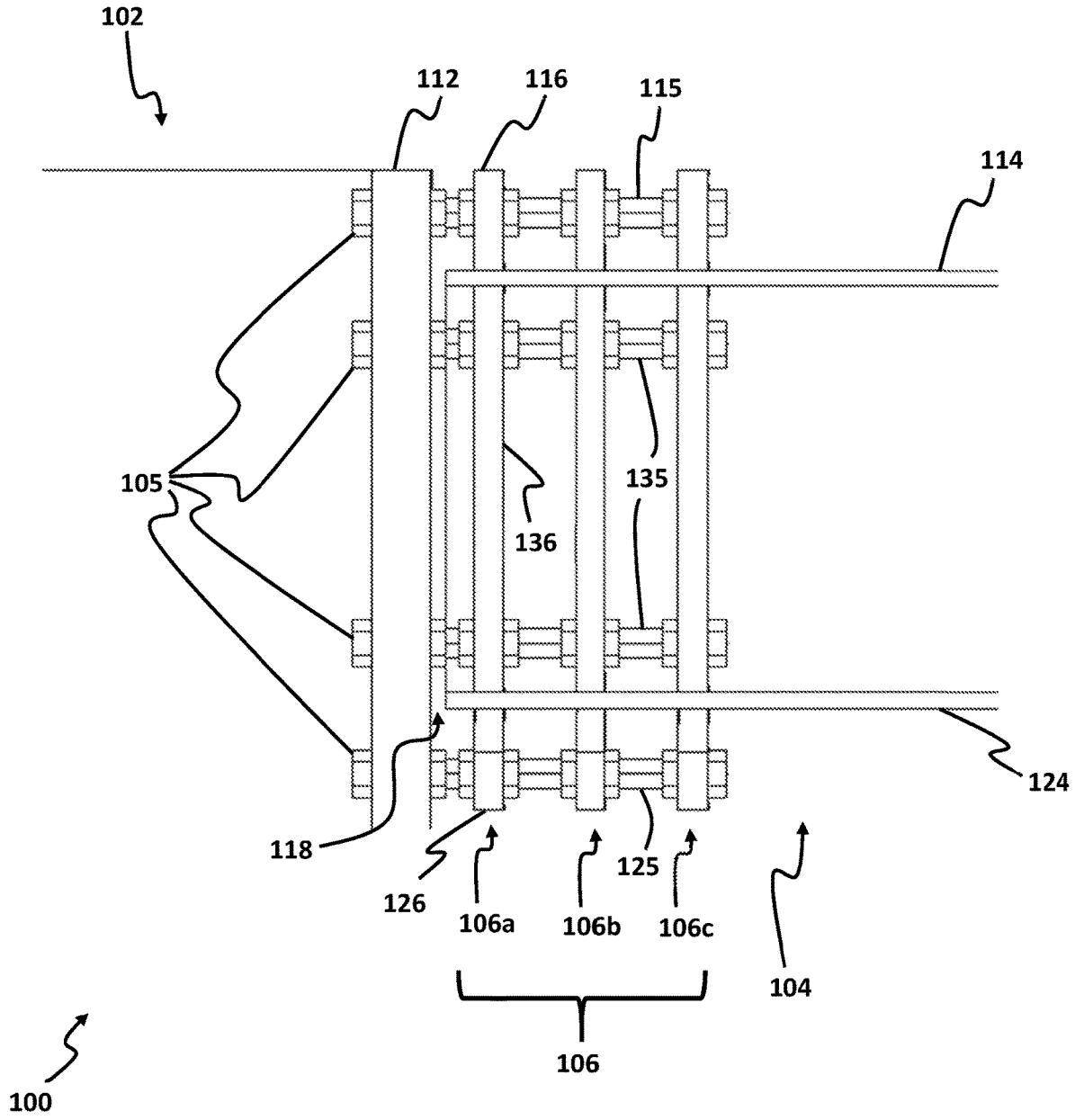
FIG. 5 illustrates a front view of a moment resisting frame, consistent with one or more exemplary embodiments of the present disclosure.

In order to secure a connection between the column 102 and the beam 104, in an exemplary embodiment, each row of the plurality of rows of coplanar plates 106 may be fixed at position relative to the lateral vertical flange 112 of the column 102. In an exemplary embodiment, as shown in FIG. 1 and FIG. 5, each plate of each row of coplanar plates 106, for example each plate of the first row of coplanar plates 106*a*, may be secured into a substantially fixed position relative to the lateral vertical flange 112 of the column 102. In an exemplary embodiment, the top plate 116 may be secured into a substantially fixed position relative to the lateral vertical flange 112 of the column 102 by tightening a plurality of top lock screws 115 inside the plurality of top threaded holes 117 and the plurality of top flange threaded holes 122. Similarly, in an exemplary embodiment, the bottom plate 116 may be secured into a substantially fixed position relative to the lateral vertical flange 112 of the column 102 by tightening a plurality of bottom lock screws 115 inside the plurality of bottom threaded holes 127 and the plurality of bottom flange threaded holes 132. And also similarly, in an exemplary embodiment, the first lateral plate 136 may be secured into a substantially fixed position relative to the lateral vertical flange 112 of the column 102 by tightening a plurality of first lateral lock screws 135 inside the plurality of first lateral threaded holes 137 and the plurality of first lateral flange threaded holes 142; and the second lateral plate 146 may be secured into a substantially fixed position relative to the lateral vertical flange 112 of the column 102 by tightening a plurality of second lateral lock screws inside the plurality of second lateral threaded holes 147 and the plurality of second lateral flange threaded holes 152.

In an exemplary embodiment, plates of row of coplanar plates 106, for example, each plate of the first row of coplanar plates 106*a* may be secured at its respective reposition relative to the lateral vertical flange 112 by any other fastening mechanisms or processes. Benefits from securing the plates of each row of coplanar plates 106 at their positions relative to the lateral vertical flange 112 may include but are not limited to a tight securement of the beam 104 at its position relative to the column 102.

In order to ensure the tight securement of the top plate 116, the bottom plate 126, the first lateral plate 136, and the second lateral plate 146 at their positions relative to the lateral vertical flange 112 of the beam 102, in some embodiments, a plurality of lock nuts 105 may be tightened on the plurality of top lock screws 115, the plurality of bottom lock screws 125, the plurality of first lateral lock screws 135, and the plurality of second lateral lock screws. For example, in an exemplary embodiment, the securement of each respective plate of the row of coplanar plates 106 at its position relative to the lateral vertical flange 112 of the column 102 may be ensured by tightening two lock nuts 105 on respective lock screw at both sides of the respective plate. Similarly, two lock nuts 105 may be tightened on each of the plurality of top lock screws 115, the plurality of bottom lock screws 125, the plurality of first lateral lock screws 135, and the plurality of second lateral lock screws at both sides of the lateral vertical flange 112. In an exemplary embodiment, in order to ensure that the moment-resisting frame 100 are not damaged under relatively high loads, the plurality of lock nuts 105 may be manufactured from a high strength steel. However, in different implementations, the plurality of lock nuts 105 may be manufactured from any other renitent material such as st37.

With the further reference to FIG. 5, in an exemplary embodiment, the column 102 and the beam 104 may be arranged in a perpendicular configuration such that a gap 118 is defined between the column 102 and the beam 104. In an exemplary embodiment, the gap 118 is about 3 cm to 5 cm, though in other cases, according to size of the column 102 and the beam 104 and some other considerations, it may range between 0 cm and 10 cm. Benefits from arranging the column 102 and the beam 104 in a way such that the gap 118 is defined between the column 102 and the beam 104 may include but are not limited to an increase in stability of the moment-resisting frame 100 by, for example, increasing deformability of the beam 104 under high loads without any damage to the column 102.

As presented herein, the disclosed system and apparatus may be able provide a facility for connecting beams and columns of a moment-resisting frame by retrofitting a plurality of plates to an outermost periphery of the beam and then securing the plurality of plates at their positions relative to the column by utilizing a plurality of lock screws. The connection of beam and column of the disclosed moment-resisting frame may make the moment-resisting frame able to withstand against great unpredictable loads including loads caused by such events as earthquakes with minimum or otherwise zero damage and/or deformation.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A moment-resisting frame, comprising:

a column comprising a lateral vertical flange, the lateral vertical flange including a top flange threaded hole, a bottom flange threaded hole, a first lateral flange threaded hole, and a second lateral flange threaded hole;

a beam comprising a top horizontal flange, a bottom horizontal flange, and a vertical web fitted securely between the top horizontal flange and the bottom horizontal flange, the vertical web including a first side and a second side;

a plurality of rows of coplanar plates, the plurality of rows of coplanar plates arranged in a parallel configuration relative to the lateral vertical flange, each row of the plurality of rows of coplanar plates comprising:

a top plate including a top threaded hole associated with the top flange threaded hole, the top plate attached horizontally to a top side of the top horizontal flange in a perpendicular configuration relative to a main axis of the beam;

a bottom plate including a bottom threaded hole associated with the bottom flange threaded hole, the bottom plate attached horizontally to a bottom side of the bottom horizontal flange in a perpendicular configuration relative to the main axis of the beam;

a first lateral plate including a first lateral threaded hole associated with the first lateral flange threaded hole, the first lateral plate attached vertically to the first side of the vertical web in a perpendicular configuration relative to the main axis of the beam; and a second lateral plate including a second lateral threaded hole associated with the second lateral flange threaded hole, the second lateral plate attached vertically to the second side of the vertical web in a perpendicular configuration relative to the main axis of the beam.

2. The moment-resisting frame of claim 1, wherein:

the top plate is secured into a substantially fixed position by a top lock screw inside the top threaded hole and the top flange threaded hole;

the bottom plate is secured into a substantially fixed position by a bottom lock screw inside the bottom threaded hole and the bottom flange threaded hole;

the first lateral plate is secured into a substantially fixed position by a first lateral lock screw inside the first lateral threaded hole and the first lateral flange threaded hole; and the second lateral plate is secured into a substantially fixed position by a second lateral lock screw inside the second lateral threaded hole and the second lateral flange threaded hole.

3. The moment-resisting frame of claim 1, wherein the lateral vertical flange is located opposite to the beam.

4. The moment-resisting frame of claim 1, wherein the lateral vertical flange has a substantially rectangular shape.

5. The moment-resisting frame of claim 1, wherein the top horizontal flange, the bottom horizontal flange, and the vertical web have a substantially rectangular shape.

6. The moment-resisting frame of claim 1, wherein the first lateral plate and the second lateral plate are attached horizontally to a bottom side of the top horizontal flange and a top side of the bottom horizontal flange.

7. The moment-resisting frame of claim 1, wherein the top plate, the bottom plate, the first lateral plate, and the second lateral plate are attached to the beam by welding process.

8. The moment-resisting frame of claim 1, wherein the beam, the column, the top plate, the bottom plate, the first lateral plate, and the second lateral plate are manufactured from stainless steel 37.

9. The moment-resisting frame of claim 1, wherein the top lock screw, the bottom lock screw, the first lateral lock screw, and the second lateral lock screw are manufactured from high strength steel.

10. The moment-resisting frame of claim 1, wherein there is a gap with a width ranging between 1 cm to 5 cm between an outer vertical section of the beam and an outer surface of the vertical flange.

11. The moment-resisting frame of claim 1, wherein the top lock screw, the bottom lock screw, the first lateral lock screw, and the second lateral lock screw are secured into a substantially fixed position by a plurality of nuts.

* * * * *